US006499972B2

(12) United States Patent
Yatsuzuka et al.

(10) Patent No.: US 6,499,972 B2
(45) Date of Patent: Dec. 31, 2002

(54) LINEAR COMPRESSOR

(75) Inventors: Shinichi Yatsuzuka, Nisshin (JP); Yasumasa Hagiwara, Nisshin (JP); Keiji Takizawa, Nisshin (JP)

(73) Assignee: Cryodevice Inc., Aichi (JP)

( * ) Notice: Subject to any disclaimer, the term of this patent is extended or adjusted under 35 U.S.C. 154(b) by 35 days.

(21) Appl. No.: 09/861,662

(22) Filed: May 22, 2001

(65) Prior Publication Data

US 2001/0051099 A1 Dec. 13, 2001

(30) Foreign Application Priority Data

May 23, 2000 (JP) ..... 2000-151363

(51) Int. Cl.[7] ..... F04B 17/04

(52) U.S. Cl. ..... 417/417; 417/419; 417/416; 417/488

(58) Field of Search ..... 417/417, 419, 417/416, 488, 410.1

(56) References Cited

U.S. PATENT DOCUMENTS 5,389,844 A 2/1995 Yarr et al.
5,693,991 A * 12/1997 Hiterer et al. ..... 310/30
6,129,527 A * 10/2000 Donahoe et al. ..... 417/416
6,138,459 A * 10/2000 Yatsuzuka et al. ..... 62/6
6,203,292 B1 * 3/2001 Morita et al. ..... 417/417

* cited by examiner

*Primary Examiner*—Charles G. Freay
*Assistant Examiner*—Michael K. Gray
(74) *Attorney, Agent, or Firm*—Richard L. Aitken; Venable

(57) ABSTRACT

A linear compressor, comprises a retaining member, a fixed member supported by said retaining member and formed with a hermetically sealed compression chamber to receive a working fluid therein, a pair of pistons axially movably received in said compression chamber to assume respective compression positions, a pair of piston rods each having an outer peripheral portion and slidably movably supported by said fixed member, said piston rods respectively connected to said pistons to have said pistons axially move in said compression chamber, a plurality of magnet units mounted on each of said outer peripheral portions of said piston rods, each of said magnet units having a plurality of magnet segments each made of a permanent magnet and circumferentially arranged with neighboring two magnet segments different in magnetic pole, a plurality of electromagnet units supported by said retaining member to be axially spaced apart from each other in predetermined relationship with said magnet units, respectively, and resilient means for resiliently urging said piston rods to cause said piston rods to assume respective neutral positions.

28 Claims, 8 Drawing Sheets

LINEAR COMPRESSOR

BACKGROUND OF THE INVENTION

1. Field of the Invention

The present invention relates to a linear compressor and more particularly to a moving magnet type of linear compressor that is of a high efficiency and used for a cooling machine. The present invention is concerned with an improved linear compressor so constructed as to ensure that the linear compressor effectively increases a density of magnetic flux passing through an electromagnet unit to impart an increased thrust force to a piston forming part of the linear compressor.

2. Description of the Related Art

There have so far been proposed a wide variety of prior-art linear compressors one of which is exemplified and shown in FIG. 8. The prior-art linear compressor 10 thus proposed comprises a fixed member 11 formed with a hermetically sealed compression chamber to receive a working fluid therein, a piston rod 12 slidably movably supported by the fixed member 11 and connected to the piston serving to compress the working fluid in the compression chamber, a magnet unit 13 including a plurality of yoke portions 14 and 15 accommodated in the piston rod 12 and a permanent magnet 16 in the form of a rectangular shape in cross-section and supported by the yoke portions 14 and 15 to be positioned in the center portion of the piston rod 12 and an electromagnetic unit 17 including a peripheral portion 18, a plurality of yoke portions 19 and 20 radially inwardly extending from the peripheral portion 18 and a plurality of magnetic coils 21 and 22 each wound around each of the yoke portions 19 and 20. The permanent magnet 16 of the magnet unit 13 is arranged in face-to-face relationship with the yoke portions 19 and 20 of the electromagnet units 17 in the longitudinal direction of the piston rod 12.

The prior-art linear compressor thus constructed encounters such a problem as failing to effectively increase the density of magnetic flux passing through the yoke portions 19 and 20 of the electromagnet units 17 by the reason that the permanent magnet 16 of the magnet unit 13 is embedded in the center portion of the piston rod 12 as shown in FIG. 8. The failure in effective increase of the density of magnetic flux makes it almost impossible to impart an increased thrust force to the piston forming part of the linear compressor.

SUMMARY OF THE INVENTION

It is therefore a primary object of the present invention to provide a linear compressor that can effectively increase the density of magnetic flux passing through the electromagnet unit to impart an increased thrust force to the piston forming part of the linear compressor.

It is another object of the present invention to provide a linear compressor that can increase the operating efficiency.

It is a further object of the present invention to provide a linear compressor that can be reduced in size.

It is a still further object of the present invention to provide a linear compressor that can reduce the electric consumption.

It is a yet still further object of the present invention to provide a linear compressor that can reduce the electric heat value.

In accordance with a first aspect of the present invention, there is provided a linear compressor, comprising: a retaining member; a fixed member supported by the retaining member and formed with a hermetically sealed compression chamber to receive a working fluid therein, the fixed member having a longitudinally central portion formed with a inlet-outlet port having the working fluid introduced therein and discharged therefrom; a pair of pistons axially movably received in the compression chamber to assume respective compression positions where the working fluid is compressed in and discharged out of the compression chamber through the inlet-outlet port and respective retraction positions where the working fluid is expanded and introduced in the compression chamber through the inlet-outlet port; a pair of piston rods each having an outer peripheral portion and slidably movably supported by the fixed member, the piston rods respectively connected to the pistons to have the pistons axially move in the compression chamber, each of the piston rods made of a ferromagnetic material; a plurality of magnet units mounted on each of the outer peripheral portions of the piston rods, each of the magnet units having a plurality of magnet segments each made of a permanent magnet and circumferentially arranged with neighboring two magnet segments different in magnetic pole; a plurality of electromagnet units supported by the retaining member to be axially spaced apart from each other in predetermined relationship with the magnet units, respectively; and resilient means for resiliently urging the piston rods to cause the piston rods to assume respective neutral positions between the compression positions and the retraction positions.

Each of the electromagnet units may include a peripheral portion, a plurality of yoke portions radially inwardly extending from the peripheral portion and integrally formed with the peripheral portion, the yoke portions being circumferentially equally spaced apart from each other, and a plurality of magnetic coils each wound around each of the yoke portions.

Each of the yoke portions of electromagnet units may have an axial length substantially equal to that of each of the magnet units.

The magnet units may include neighboring two magnet units having respective center planes each perpendicular to the center axis of each of the piston rods, and the yoke portions of the electromagnet units have respective center planes each perpendicular to the center axis of each of the piston rods, each of the center planes of the yoke portions of the electromagnet units being positioned between the center planes of the neighboring two magnet units when the piston rods assume their respective neutral positions.

Each of the yoke portions of the electromagnet units may be constituted by a plurality of piled plates each made of a ferromagnetic material and having a plane extending along the center axis of each of the piston rods.

The linear compressor may further comprise a pair of positioning members each mounted on the fixed member with respect to the magnet units, each of the positioning members formed with a plurality of annular grooves axially spaced apart from each other, each of the annular grooves functioning to facilitate positioning of each of the yoke portions of the electromagnet units with the magnet units.

Each of the yoke portions of the electromagnet units may have a radially outer end portion made of a ferromagnetic material and a radially inner end portion made of a ferromagnetic material having a saturated density of magnetic flux higher than that of the ferromagnetic material of each of the radially outer end portions of the yoke portions to ensure that the density of magnetic flux of each of the yoke portions of the electromagnet units is more increased than that of each of the yoke portions of the electromagnet units which are made of the same ferromagnetic materials.

The ferromagnetic material of each of the radially inner end portions may be made of Permendur.

Each of the magnet segments of the magnet units may be constituted by a plurality of piled plates each made of a permanent magnet and having a plane extending perpendicular to the center axis of each of the piston rods.

The resilient means may include a plurality of resilient members disposed along each of the piston rods, each of the resilient members constituted by a plurality of leaf springs each having a plane extending perpendicular to the center axis of each of the piston rods, each of the resilient members having a inner end portion fixedly connected to each of the piston rods and a outer end portion fixedly connected to the fixed member to ensure that each of the piston rods is resiliently urged and restored to the respective neutral positions when each of the piston rods is axially moved to the compression positions and the retraction positions.

The fixed member may have an inner peripheral portion held in sliding engagement with the pistons and made of a material substantially equal in thermal expansion coefficient to the material of each of the pistons.

The pair of pistons and the pair of piston rods may be located in symmetrical relationship with each other with respect to the inlet-outlet port.

The resilient members may be located in symmetrical relationship with each other with respect to the inlet-outlet port.

The working fluid may be made of a gas selected from the group consisting of helium, nitrogen, hydrogen, and neon-argon.

The permanent magnet of each of the magnet segments may be made of a ferroalloy containing nickel.

In accordance with a second aspect of the present invention, there is provided a linear compressor, comprising: a retaining member, a fixed member supported by the retaining member and formed with a hermetically sealed compression chamber to receive a working fluid therein, the fixed member having a longitudinally end portion formed with a inlet-outlet port having the working fluid introduced therein and discharged therefrom; a piston axially movably received in the compression chamber to assume a compression position where the working fluid is compressed in and discharged out of the compression chamber through the inlet-outlet port and a retraction position where the working fluid is expanded and introduced in the compression chamber through the inlet-outlet port; a piston rod having an outer peripheral portion and slidably movably supported by the fixed member, the piston rod connected to the piston to have the piston axially move in the compression chamber, the piston rod made of a ferromagnetic material; a plurality of magnet units mounted on the outer peripheral portion of the piston rod, each of the magnet units having a plurality of magnet segments each made of a permanent magnet and circumferentially arranged with neighboring two magnet segments different in magnetic pole; a plurality of electromagnet units supported by the retaining member to be axially spaced apart from each other in predetermined relationship with the magnet units, respectively; and resilient means for resiliently urging the piston rod to cause the piston rod to assume neutral position between the compression position and the retraction position.

Each of the electromagnet units may include a peripheral portion, a plurality of yoke portions radially inwardly extending from the peripheral portion and integrally formed with the peripheral portion, the yoke portions being circumferentially equally spaced apart from each other, and a plurality of magnetic coils each wound around each of the yoke portions.

Each of the yoke portions of electromagnet units may have an axial length substantially equal to that of each of the magnet units.

The magnet units may include neighboring two magnet units having respective center planes each perpendicular to the center axis of the piston rod, and the yoke portions of the electromagnet units have respective center planes each perpendicular to the center axis of the piston rod, each of the center planes of the yoke portions of the electromagnet units being positioned between the center planes of the neighboring two magnet units when the piston rod assumes its neutral position.

Each of the yoke portions of the electromagnet units may be constituted by a plurality of piled plates each made of a ferromagnetic material and having a plane extending along the center axis of the piston rod.

The linear compressor may further comprise a positioning member mounted on the fixed member with respect to the magnet units, the positioning member formed with a plurality of annular grooves axially spaced apart from each other, each of the annular grooves functioning to facilitate positioning of each of the yoke portions of the electromagnet units with the magnet units.

Each of the yoke portions of the electromagnet units may have a radially outer end portion made of a ferromagnetic material and a radially inner end portion made of a ferromagnetic material having a saturated density of magnetic flux higher than that of the ferromagnetic material of each of the radially outer end portions of the yoke portions to ensure that the density of magnetic flux of each of the yoke portions of the electromagnet units is more increased than that of each of the yoke portions of the electromagnet units which are made of the same ferromagnetic materials.

The ferromagnetic material of each of the radially inner end portions may be made of Permendur.

Each of the magnet segments of the magnet units may be constituted by a plurality of piled plates each made of a permanent magnet and having a plane extending perpendicular to the center axis of the piston rod.

The resilient means may include a plurality of resilient members disposed along the piston rod, each of the resilient members constituted by a plurality of leaf springs each having a plane extending perpendicular to the center axis of the piston rod, each of the resilient members having a inner end portion fixedly connected to the piston rod and a outer end portion fixedly connected to the fixed member to ensure that the piston rod is resiliently urged and restored to the neutral position when the piston rod is axially moved to the compression position and the retraction position.

The fixed member may have an inner peripheral portion held in sliding engagement with the piston and made of a material substantially equal in thermal expansion coefficient to the material of the piston.

The working fluid may be made of a gas selected from the group consisting of helium, nitrogen, hydrogen, and neon-argon.

The permanent magnet of each of the magnet segments may be made of a ferroalloy containing nickel.

BRIEF DESCRIPTION OF THE DRAWINGS

The features and advantages of a linear compressor according to the present invention will more clearly be understood from the following description taken in conjunction with the accompanying drawings in which.

DESCRIPTION OF THE PREFERRED EMBODIMENTS

Figure 1:
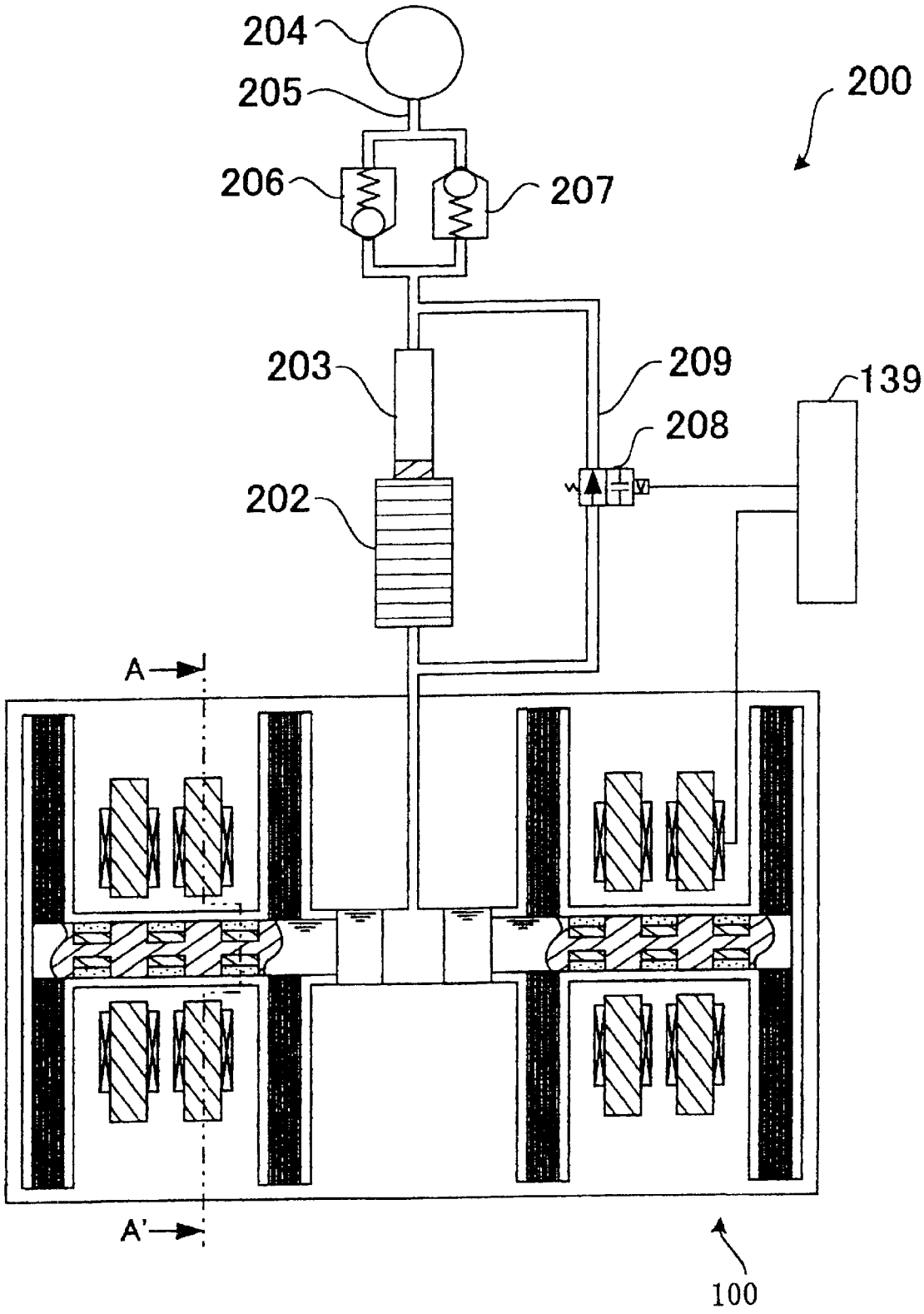
FIG. 1 is a cross-sectional view of the first embodiment of the linear compressor according to the present invention in combination with the pulse tube type cooling machine.

The first preferred embodiment of a linear compressor according to the present invention will now be described in detail in accordance with the accompanying drawings.

Referring now to the drawings, particularly to FIGS. 1 to 6, here are shown the first preferred embodiment of a linear compressor 100 according to the present invention and a pulse tube type cooling machine 200 operatively connected to the linear compressor 100. The linear compressor 100 comprises a retaining member 101, a fixed member 102 in the form of a cylindrical shape and supported by the retaining member 101 and formed with a hermetically sealed compression chamber 103 in the form of a cylinder shape to receive a working fluid therein. The fixed member 102 has a longitudinally central portion 104 and an inner peripheral portion 105. The longitudinally central portion 104 of the fixed member 102 is formed with a inlet-outlet port 106 having the working fluid introduced therein and discharged therefrom. The working fluid is made of a gas selected from the group consisting of helium, nitrogen, hydrogen, and neon-argon.

The linear compressor 100 further comprises a pair of pistons 107 and 108 each in the form of a cylinder shape and axially movably received in the compression chamber 103 to assume respective compression positions where the working fluid is compressed in and discharged out of the compression chamber 103 through the in-let-outlet port 106 and respective retraction positions where the working fluid is expanded and introduced in the compression chamber 103 through the inlet-outlet port 106. The inner peripheral portion 105 of the fixed member 102 is held in sliding engagement with the pistons 107 and 108 and made of a material substantially equal in thermal expansion coefficient to the material of each of the pistons 107 and 108.

The linear compressor 100 further comprises a pair of piston rods 109 and 110 each having an outer peripheral portion 111 and 112. The piston rods 109 and 110 are slidably movably supported by the fixed member 102 and respectively connected to the pistons 107 and 108 to have the pistons 107 and 108 axially move in the compression chamber 103. Each of the piston rods 109 and 110 is in the form of a cylinder shape and made of a ferromagnetic material. The pair of pistons 107 and 108 and the pair of piston rods 109 and 110 are located in symmetrical relationship with each other with respect to the inlet-outlet port 106.

Figure 3A:
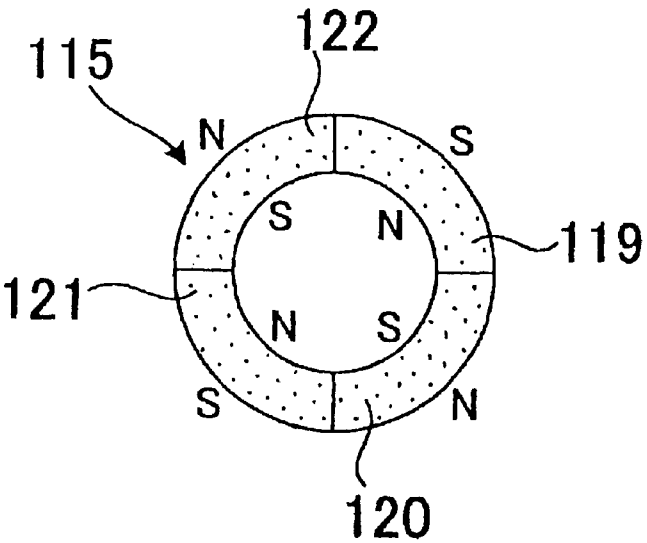
FIG. 3A is an enlarged cross-sectional view of the magnet unit.
Figure 3B:
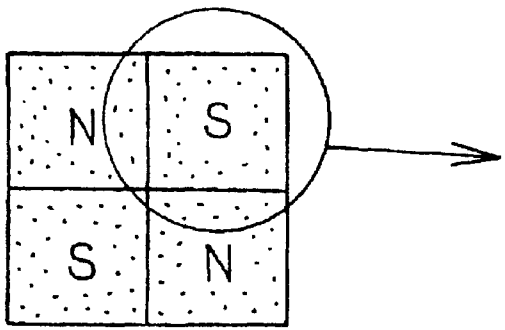
FIG. 3B is a view of a model for explaining the magnetic pole of the magnet unit shown in FIG. 3A.
Figure 3C:
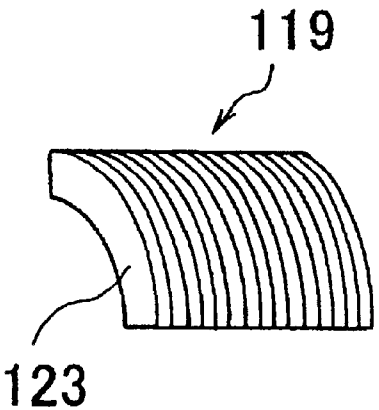
FIG. 3C is a perspective view of the magnet segment of the magnet unit.

The linear compressor 100 further comprises a plurality of magnet units 113 to 118 each in the form of an annular ring shape and mounted on each of the outer peripheral portions 111 and 112 of the piston rods 109 and 110 to be axially spaced apart from each other. The cross-section of the magnet unit 115 is shown in FIGS. 3A, 3B and 3C to have a plurality of magnet segments 119 to 122 each made of a permanent magnet and circumferentially arranged with neighboring two magnet segments different in magnetic pole. Each of the magnet segments 119 to 122 of the magnet unit 115 is constituted by a plurality of piled plates 123 each made of a permanent magnet and having a plane extending perpendicular to the center axis 124 of each of the piston rods 109 and 110. The permanent magnet of each of the magnet segments 119 to 122 of the magnet unit 115 is made of a ferroalloy containing nickel.

While it has been described about the above embodiment that the linear compressor 100 comprises a plurality of magnet units 113 to 118 mounted on each of the outer peripheral portions 111 and 112 of the piston rods 109 and 110 to be axially spaced apart from each other, the magnet units 113 to 118 may be mounted on each of the outer peripheral portions 111 and 112 of the piston rods 109 and 110 in face-to-face contact with each other in the axial direction of the piston rods 109 and 110 according to the present invention. This means that the side surfaces of the magnet units 113 to 118 may be held in abutting engagement with each other.

The cross-section of the magnet units 113, 114, 116, 117, 118 are not shown in FIGS. 3A, 3B and 3C but entirely the same as the cross-section of the magnet unit 115. It will thus be understood that the constructions of the magnet units 113, 114, 116, 117, 118 are entirely the same as that of the magnet unit 115. The constructions of the magnet units 113,114,116, 117,118 will therefore not be described hereinafter.

Figure 4B:
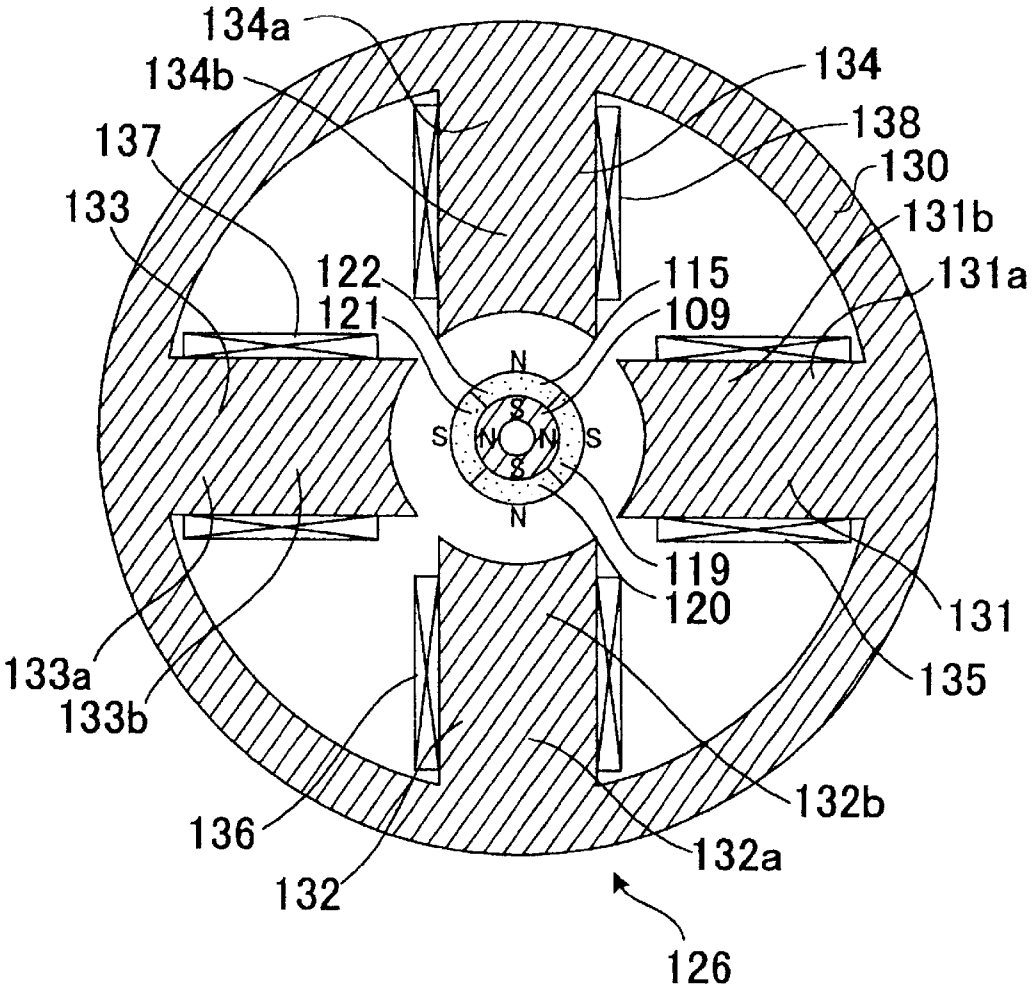
FIG. 4B is an enlarged cross-sectional view taken along the lines A–A' of FIG. 1.
Figure 4A:
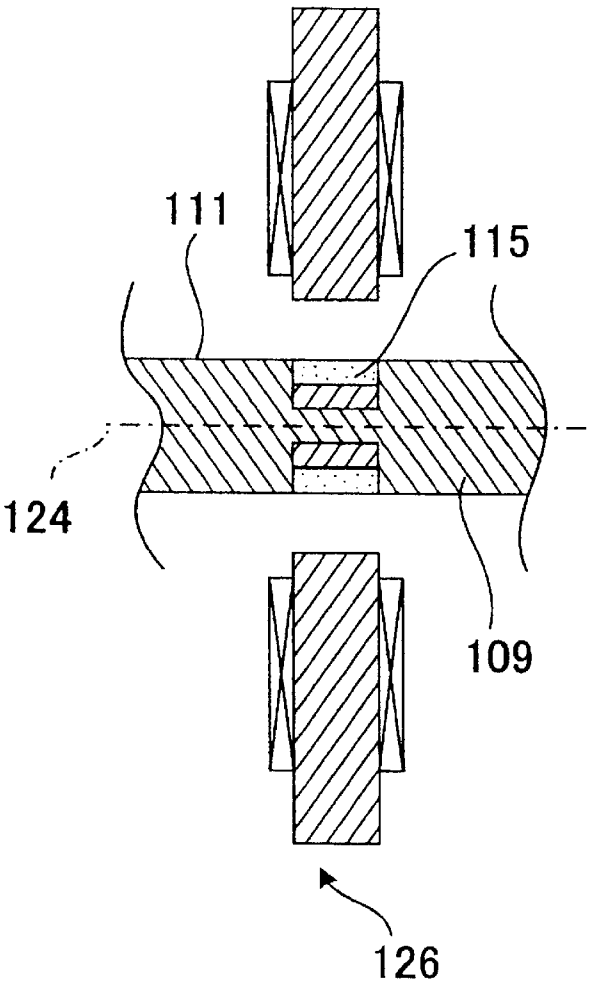
FIG. 4A is an enlarged fragmentary cross-sectional view taken along the lines A–A' of FIG. 1.
Figure 5:
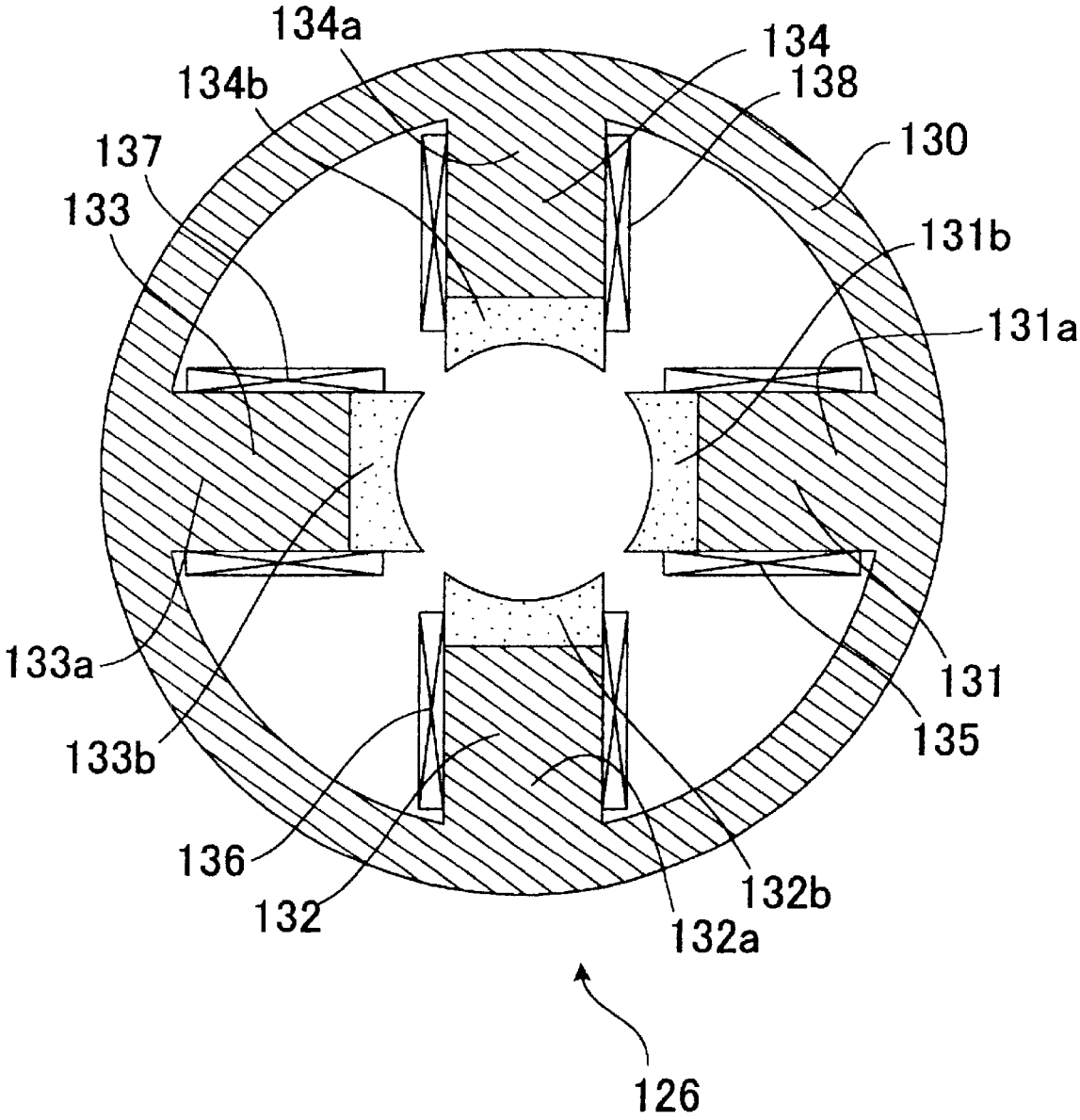
FIG. 5 is a view similar to FIG. 4B but particularly showing the yoke portions each having a radially inner end portion made of a ferromagnetic material.

The linear compressor 100 further comprises a plurality of electromagnet units 125 to 128 supported by the retaining member 101 to be axially spaced apart from each other in predetermined relationship with the magnet units 113 to 118, respectively. The cross-section of the electromagnet unit 126 is shown in FIGS. 4A, 4B and 5 to include a peripheral portion 130 in the form of an annular ring shape, a plurality of yoke portions 131 to 134, and a plurality of magnetic coils 135 to 138. The yoke portions 131 to 134 of the electromagnet unit 126 radially inwardly extend from the peripheral portion 130. The yoke portions 131 to 134 of the electromagnet unit 126 are integrally formed with the peripheral portion 130 and circumferentially equally spaced apart from each other. The magnetic coils 135 to 138 of the electromagnet unit 126 are each wound around each of the yoke portions 131 to 134 and controlled by a controller 139 to be actuated alternately in magnet pole.

Each of the yoke portions 131 to 134 of the electromagnet unit 126 has an axial length substantially equal to that of each of the magnet units 113 to 118. Each of the yoke portions 131 to 134 of the electromagnet unit 126 is constituted by a plurality of piled plates each made of a ferromagnetic material and having a plane extending along the center axis 124 of each of the piston rods 109 and 110.

In FIG. 5, each of the yoke portions 131 to 134 of the electromagnet unit 126 has a radially outer end portion 131*a* to 134*a* made of a ferromagnetic material and a radially inner end portion 131*b* to 134*b* made of a ferromagnetic material having a saturated density of magnetic flux higher than that of the ferromagnetic material of each of the radially outer end portions 131*a* to 134*a* of the yoke portions 131 to 134 to ensure that the density of magnetic flux of each of the yoke portions 131 to 134 of the electromagnet unit 126 is more increased than that of each of the yoke portions 131 to 134 of the electromagnet unit 126 which are made of the same ferromagnetic materials. The ferromagnetic material of each of the radially inner end portions 131*b* to 134*b* of the yoke portions 131 to 134 is made of Permendur.

The cross-sections of the electromagnet units 125, 127 and 128 are not shown in FIGS. 4A, 4B, and 5 but entirely the same as the cross-section of the electromagnet unit 126. It will thus be understood that the constructions of the electromagnet units 125, 127 and 128 are entirely the same as that of the electromagnet unit 126. The constructions of the electromagnet units 125, 127 and 128 will therefore not be described hereinafter.

The magnet units 113 to 118 include neighboring two magnet units having respective center planes each perpendicular to the center axis 124 of each of the piston rods 109 and 110. The yoke portions 131 to 134 of the electromagnet units 125 to 128 have respective center planes each perpendicular to the center axis 124 of each of the piston rods 109 and 110. Each of the center planes of the yoke portions 131 to 134 of the electromagnet units 125 to 128 are positioned between the center planes of the neighboring two magnet units when the piston rods 109 and 110 assume their respective neutral positions.

The linear compressor 100 further comprises resilient means 150 for resiliently urging the piston rods 109 and 110 to cause the piston rods 109 and 110 to assume respective neutral positions between the compression positions and the retraction positions. The resilient means 150 includes a plurality of resilient members 151 to 158 disposed along each of the piston rods 109 and 110. Each of the resilient members 151 to 158 are constituted by a plurality of leaf springs each having a plane extending perpendicular to the center axis 124 of each of the piston rods 109 and 110. Each of the resilient members 151 to 158 has a inner end portion 151*a* to 158*a* fixedly connected to each of the piston rods 109 and 110 and a outer end portion 151*b* to 158*b* fixedly connected to the fixed member 102 to ensure that each of the piston rods 109 and 110 is resiliently urged and restored to the respective neutral positions when each of the piston rods 109 and 110 is axially moved to the compression positions and the retraction positions. The resilient members 151 to 158 are located in symmetrical relationship with each other with respect to the inlet-outlet port 106.

Figure 6B:
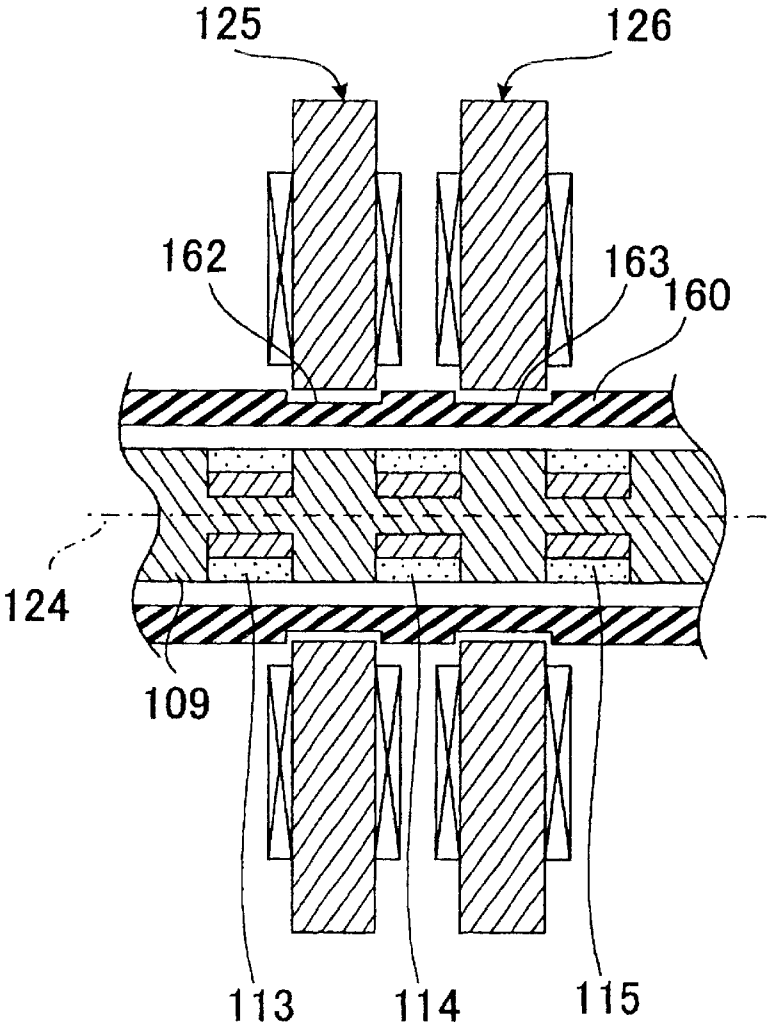
FIG. 6B is a cross-sectional view of the positioning member shown in FIG. 6A.
Figure 6A:
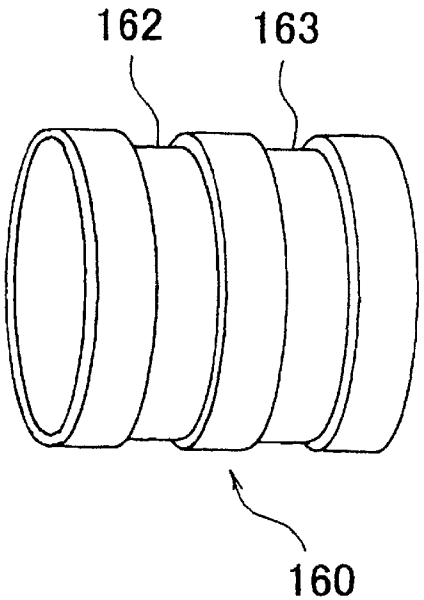
FIG. 6A is a perspective view of the positioning member of the linear compressor according to the present invention.

The linear compressor 100 further comprises a pair of positioning members 160 and 161 each in the form of a cylinder shape and mounted on the fixed member 102 with respect to the magnet units 113 to 118. The cross-section of the positioning member 160 is shown in FIGS. 6A and 6B to be formed with a plurality of annular grooves 162 and 163 axially spaced apart from each other. Each of the annular grooves 162 and 163 of the positioning member 160 functions to facilitate positioning of each of the yoke portions 131 to 134 of the electromagnet units 125 and 126 with the magnet units 113 to 115.

The cross-section of the positioning member 161 is not shown in FIGS. 6A and 6B but entirely the same as the cross-section of the positioning member 160. It will thus be understood that the constructions of the positioning member 161 is entirely the same as that of the positioning member 160. The constructions of the positioning member 161 will therefore not be described hereinafter.

The pulse tube type cooling machine 200 is operatively connected to the linear compressor 100. The pulse tube type cooling machine 200 includes a connecting pipe 201 having a passageway formed therein and connected at one end to the fixed member 102 with the passageway held in communication with the inlet-outlet port 106 of the fixed member 102, a heat accumulator 202 having one end connected to the other end of the connecting pipe 201 to accumulate the working fluid fed through the passageway of the connecting pipe 201 from the compression chamber 103 of the fixed member 102 and the other end through which the working fluid is discharged, a pulse tube 203 having one end connected to the other end of the heat accumulator 202 to discharge heat therefrom, a buffer tank 204 connected to the other end of the pulse tube 203 by way of a connecting pipe 205 having a portion bifurcated and having a pair of check valves 206 and 207 therein to allow the working fluid to be checked, a change-over valve 208 provided on a connecting pipe 209 and controlled by a controller 139 on whether the change-over valve 208 is opened or closed.

As will be understood form the forgoing description, the magnet units are mounted on each of the outer peripheral portions of the piston rods to be axially spaced apart from each other, the electromagnet units are supported by the retaining member to be axially spaced apart from each other in predetermined relationship with the magnet units respectively, each of the magnet segments of the magnet units is constituted by a plurality of piled plates and having a plane extending perpendicular to the center axis of each of the piston rods, and each of the yoke portions of the electromagnet units is constituted by a plurality of piled plates and having a plane extending along the center axis of each of the piston rods.

The liner compressor thus constructed in the above makes it possible (1) to increase the density of magnetic flux passing through the electromagnet unit to impart an increased thrust force to the piston forming part of the linear compressor, (2) to increase the operating efficiency, (3) to be reduced in size, (4) to reduce the electric consumption, (5) to reduce the electric heat value, and (6) to reduce eddy currents in the electromagnet unit.

While it has been described in the first embodiment of the linear compressor according to the present invention, the fixed member 102, the pistons 107 and 108, the piston rods 109 and 110, and the positioning members 160 and 161 are each in the form of a cylindrical shape, the fixed member 102, the pistons 107 and 108, the piston rods 109 and 110, and the positioning members 160 and 161 may be each in the form of a polygonal shape such as triangular, square and rectangular shape in cross-section.

Figure 2:
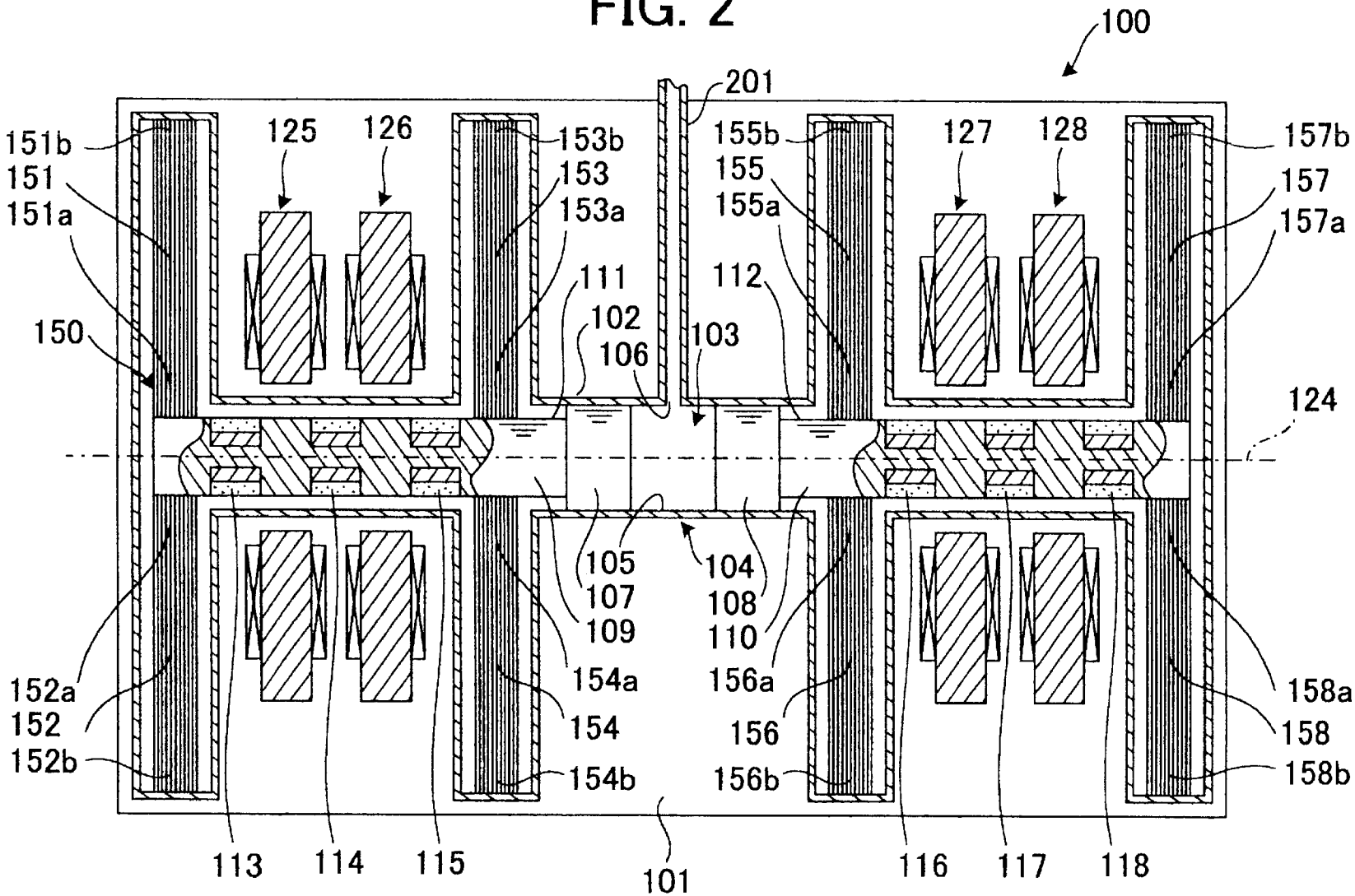
FIG. 2 is an enlarged cross-sectional view of the linear compressor shown in FIG. 1.

While the linear compressor 100 has been described in the above as comprising the pair of piston rods 109 and 110 respectively connected to the pistons 107 and 108 to have the pistons 107 and 108 axially move in the compression chamber 103 as shown in FIG. 2, the linear compressor 100 may be replaced by a linear compressor comprising a single piston rod connected to a single piston to have the single piston axially move in a compression chamber according to the present invention.

Figure 7:
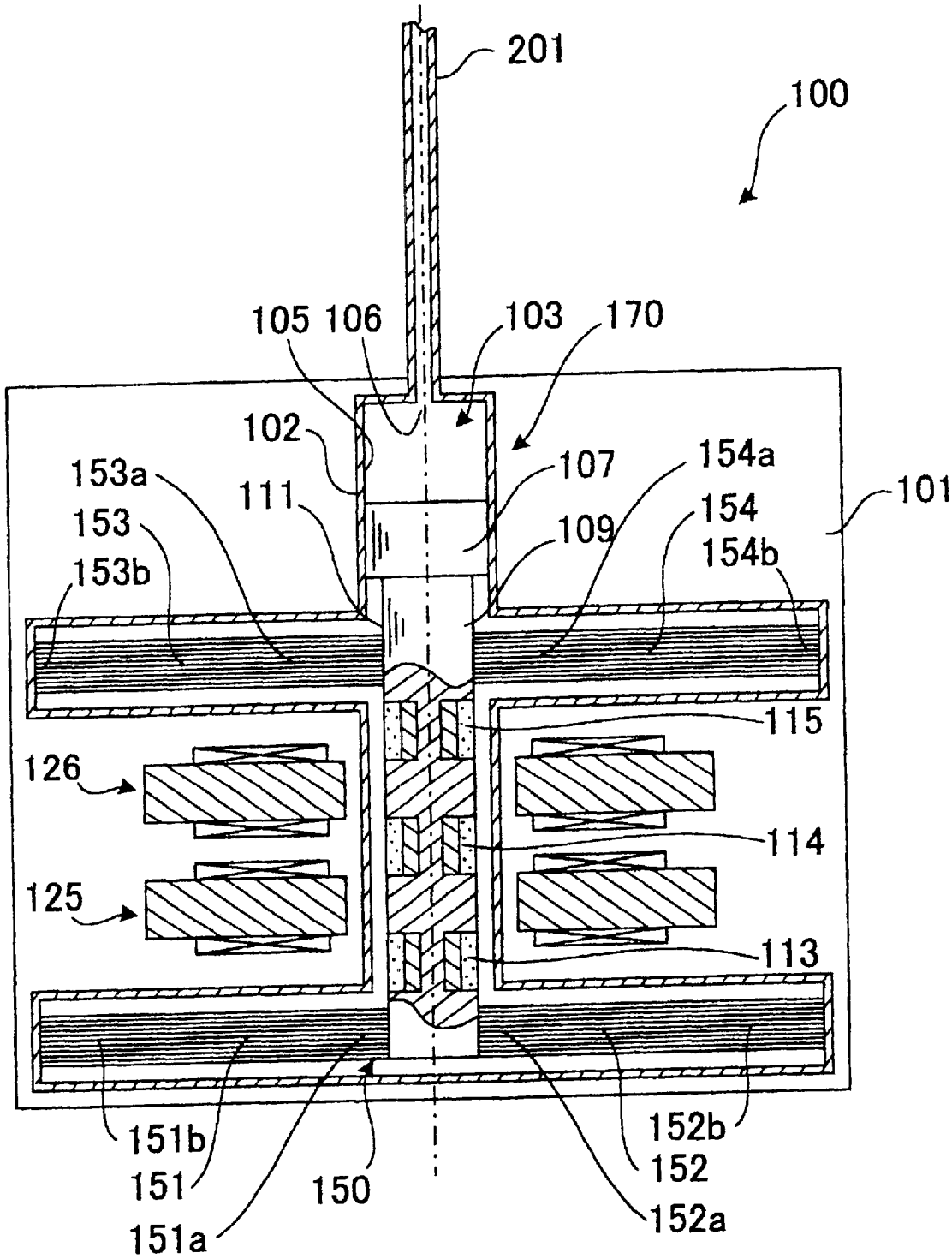
FIG. 7 is an enlarged cross-sectional view of the second embodiment of the linear compressor according to the present invention.
Figure 8:
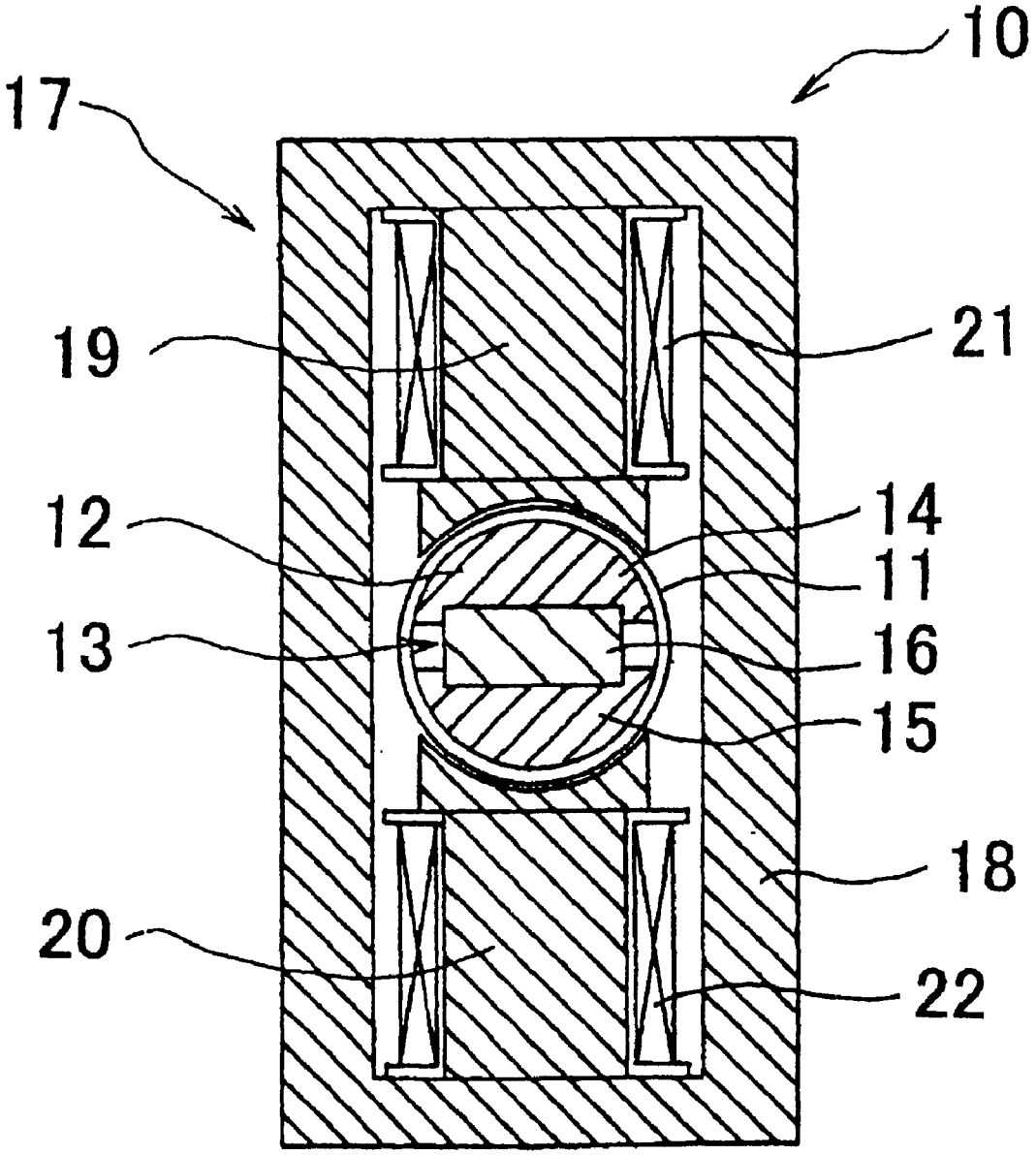
FIG. 8 PRIOR ART
FIG. 8 is an enlarged cross-sectional view of the prior-art linear compressor.

The second embodiment directed to the linear compressor comprising the single piston rod connected to the single piston to have the single piston axially move in the compression chamber is shown in FIG. 7.

In FIG. 7, the linear compressor 100 comprises a retaining member 101, a fixed member 102 supported by the retaining member 101 and formed with a hermetically sealed compression chamber 103 in the form of a cylinder shape to receive a working fluid therein. The fixed member 102 has a longitudinally end portion 170 and an inner peripheral portion 105. The longitudinally end portion 170 of the fixed member 102 is formed with a inlet-outlet port 106 having the working fluid introduced therein and discharged therefrom.

The linear compressor 100 further comprises a piston 107 axially movably received in the compression chamber 103 to assume compression position where the working fluid is compressed in and discharged out of the compression chamber 103 through the inlet-outlet port 106 and retraction position where the working fluid is expanded and introduced in the compression chamber 103 through the inlet-outlet port 106. The inner peripheral portion 105 of the fixed member 102 is held in sliding engagement with the piston 107 and made of a material substantially equal in thermal expansion coefficient to the material of each of the piston 107.

The linear compressor 100 further comprises a piston rod 109 having an outer peripheral portion 111. The piston rod 109 is slidably movably supported by the fixed member 102 and connected to the piston 107 to have the piston 107 axially move in the compression chamber 103.

The linear compressor 100 further comprises a plurality of magnet units 113 to 115 each being in the form of an annular ring shape and mounted on the outer peripheral portion 111 of the piston rod 109 to be axially spaced apart from each other.

The linear compressor 100 further comprises a plurality of electromagnet units 125 and 126 supported by the retaining member 101 to be axially spaced apart from each other in predetermined relationship with the magnet units 113 to 115, respectively.

The linear compressor 100 farther comprises resilient means 150 for resiliently urging the piston rod 109 to cause the piston rod 109 to assume neutral position between the compression position and the retraction position. The resilient means 150 includes a plurality of resilient members 151 to 154 disposed along the piston rod 109. Each of the resilient members 151 to 154 has a inner end portion 151*a* to 154*a* fixedly connected to the piston rod 109 and a outer end portion 151*b* to 154*b* fixedly connected to the fixed member 102 to ensure that the piston rod 109 is resiliently urged and restored to the neutral position when the piston rod 109 is axially moved to the compression position and the retraction position.

It is understood that the second embodiment of the linear compressor has an advantage and effect the same as that of the first embodiment of the linear compressor.

What is claimed is:

1. A linear compressor, comprising:

a retaining member;

a fixed member supported by said retaining member and formed with a hermetically sealed compression chamber to receive a working fluid therein, said fixed member having a longitudinally central portion formed with a inlet-outlet port having said working fluid introduced therein and discharged therefrom;

a pair of pistons axially movably received in said compression chamber to assume respective compression positions where said working fluid is compressed in and discharged out of said compression chamber through said inlet-outlet port and respective retraction positions where said working fluid is expanded and introduced in said compression chamber through said inlet-outlet port;

a pair of piston rods each having an outer peripheral portion and slidably movably supported by said fixed member, said piston rods respectively connected to said pistons to have said pistons axially move in said compression chamber, each of said piston rods made of a ferromagnetic material;

a plurality of magnet units mounted on each of said outer peripheral portions of said piston rods, each of said magnet units having a plurality of magnet segments each made of a permanent magnet and circumferentially arranged with neighboring two magnet segments different in magnetic pole;

a plurality of electromagnet units supported by said retaining member to be axially spaced apart from each other in predetermined relationship with said magnet units, respectively; and resilient means for resiliently urging said piston rods to cause said piston rods to assume respective neutral positions between said compression positions and said retraction positions.

2. A linear compressor as set forth in claim 1, in which each of said electromagnet units includes a peripheral portion, a plurality of yoke portions radially inwardly extending from said peripheral portion and integrally formed with said peripheral portion, said yoke portions being circumferentially equally spaced apart from each other, and a plurality of magnetic coils each wound around each of said yoke portions.

3. A linear compressor as set forth in claim 2, in which each of said yoke portions of electromagnet units has an axial length substantially equal to that of each of said magnet units.

4. A linear compressor as set forth in claim 2, in which said magnet units include neighboring two magnet units having respective center planes each perpendicular to the center axis of each of said piston rods, and said yoke portions of said electromagnet units have respective center planes each perpendicular to the center axis of each of said piston rods, each of said center planes of said yoke portions of said electromagnet units being positioned between said center planes of said neighboring two magnet units when said piston rods assume their respective neutral positions.

5. A linear compressor as set forth in claim 2, in which each of said yoke portions of said electromagnet units is constituted by a plurality of piled plates each made of a ferromagnetic material and having a plane extending along the center axis of each of said piston rods.

6. A linear compressor as set forth in claim 2, which further comprises a pair of positioning members each mounted on said fixed member with respect to said magnet units, each of said positioning members formed with a plurality of annular grooves axially spaced apart from each other, each of said annular grooves functioning to facilitate positioning of each of said yoke portions of said electromagnet units with said magnet units.

7. A linear compressor as set forth in claim 2, in which each of said yoke portions of said electromagnet units has a radially outer end portion made of a ferromagnetic material and a radially inner end portion made of a ferromagnetic material having a saturated density of magnetic flux higher than that of said ferromagnetic material of each of said radially outer end portions of said yoke portions to ensure that the density of magnetic flux of each of said yoke portions of said electromagnet units is more increased than that of each of said yoke portions of said electromagnet units which are made of the same ferromagnetic materials.

8. A linear compressor as set forth in claim 7, in which said ferromagnetic material of each of said radially inner end portions is made of Permendur.

9. A linear compressor as set forth in claim 1, in which each of said magnet segments of said magnet units is constituted by a plurality of piled plates each made of a permanent magnet and having a plane extending perpendicular to the center axis of each of said piston rods.

10. A linear compressor as set forth in claim 1, in which said resilient means includes a plurality of resilient members disposed along each of said piston rods, each of said resilient members constituted by a plurality of leaf springs each having a plane extending perpendicular to the center axis of each of said piston rods, each of said resilient members having a inner end portion fixedly connected to each of said piston rods and a outer end portion fixedly connected to said fixed member to ensure that each of said piston rods is resiliently urged and restored to said respective neutral positions when each of said piston rods is axially moved to said compression positions and said retraction positions.

11. A linear compressor as set forth in claim 1, in which said fixed member has an inner peripheral portion held in sliding engagement with said pistons and made of a material substantially equal in thermal expansion coefficient to the material of each of said pistons.

12. A linear compressor as set forth in claim 1, in which said pair of pistons and said pair of piston rods are located in symmetrical relationship with each other with respect to said inlet-outlet port.

13. A linear compressor as set forth in claim 1, in which said resilient members are located in symmetrical relationship with each other with respect to said inlet-outlet port.

14. A linear compressor as set forth in claim 1, in which said working fluid is made of a gas selected from the group consisting of helium, nitrogen, hydrogen, and neon-argon.

15. A linear compressor as set forth in claim 1, in which said permanent magnet of each of said magnet segments is made of a ferroalloy containing nickel.

16. A linear compressor, comprising:

a retaining member;

a fixed member supported by said retaining member and formed with a hermetically sealed compression chamber to receive a working fluid therein, said fixed member having a longitudinally end portion formed with a inlet-outlet port having said working fluid introduced therein and discharged therefrom;

a piston axially movably received in said compression chamber to assume a compression position where said working fluid is compressed in and discharged out of said compression chamber through said inlet-outlet port and a retraction position where said working fluid is expanded and introduced in said compression chamber through said inlet-outlet port;

a piston rod having an outer peripheral portion and slidably movably supported by said fixed member, said piston rod connected to said piston to have said piston axially move in said compression chamber, said piston rod made of a ferromagnetic material;

a plurality of magnet units mounted on said outer peripheral portion of said piston rod, each of said magnet units having a plurality of magnet segments each made of a permanent magnet and circumferentially arranged with neighboring two magnet segments different in magnetic pole;

a plurality of electromagnet units supported by said retaining member to be axially spaced apart from each other in predetermined relationship with said magnet units, respectively; and resilient means for resiliently urging said piston rod to cause said piston rod to assume neutral position between said compression position and said retraction position.

17. A linear compressor as set forth in claim 16, in which each of said electromagnet units includes a peripheral portion, a plurality of yoke portions radially inwardly extending from said peripheral portion and integrally formed with said peripheral portion, said yoke portions being circumferentially equally spaced apart from each other, and a plurality of magnetic coils each wound around each of said yoke portions.

18. A linear compressor as set forth in claim 17, in which each of said yoke portions of electromagnet units has an axial length substantially equal to that of each of said magnet units.

19. A linear compressor as set forth in claim 17, in which said magnet units include neighboring two magnet units having respective center planes each perpendicular to the center axis of said piston rod, and said yoke portions of said electromagnet units have respective center planes each perpendicular to the center axis of said piston rod, each of said center planes of said yoke portions of said electromagnet units being positioned between said center planes of said neighboring two magnet units when said piston rod assumes its neutral position.

20. A linear compressor as set forth in claim 17, in which each of said yoke portions of said electromagnet units is constituted by a plurality of piled plates each made of a ferromagnetic material and having a plane extending along the center axis of said piston rod.

21. A linear compressor as set forth in claim 17, which further comprises a positioning member mounted on said fixed member with respect to said magnet units, said positioning member formed with a plurality of annular grooves axially spaced apart from each other, each of said annular grooves functioning to facilitate positioning of each of said yoke portions of said electromagnet units with said magnet units.

22. A linear compressor as set forth in claim 17, in which each of said yoke portions of said electromagnet units has a radially outer end portion made of a ferromagnetic material and a radially inner end portion made of a ferromagnetic material having a saturated density of magnetic flux higher than that of said ferromagnetic material of each of said radially outer end portions of said yoke portions to ensure that the density of magnetic flux of each of said yoke portions of said electromagnet units is more increased than that of each of said yoke portions of said electromagnet units which are made of the same ferromagnetic materials.

23. A linear compressor as set forth in claim 22, in which said ferromagnetic material of each of said radially inner end portions is made of Permendur.

24. A linear compressor as set forth in claim 16, in which each of said magnet segments of said magnet units is constituted by a plurality of piled plates each made of a permanent magnet and having a plane extending perpendicular to the center axis of said piston rod.

25. A linear compressor as set forth in claim 16, in which said resilient means includes a plurality of resilient members disposed along said piston rod, each of said resilient members constituted by a plurality of leaf springs each having a plane extending perpendicular to the center axis of said piston rod, each of said resilient members having a inner end portion fixedly connected to said piston rod and a outer end portion fixedly connected to said fixed member to ensure that said piston rod is resiliently urged and restored to said neutral position when said piston rod is axially moved to said compression position and said retraction position.

26. A linear compressor as set forth in claim 16, in which said fixed member has an inner peripheral portion held in sliding engagement with said piston and made of a material substantially equal in thermal expansion coefficient to the material of said piston.

27. A linear compressor as set forth in claim 16, in which said working fluid is made of a gas selected from the group consisting of helium, nitrogen, hydrogen, and neon-argon.

28. A linear compressor as set forth in claim 16, in which said permanent magnet of each of said magnet segments is made of a ferroalloy containing nickel.

* * * * *

UNITED STATES PATENT AND TRADEMARK OFFICE

CERTIFICATE OF CORRECTION

PATENT NO. : 6,499,972 B2 
DATED : December 31, 2002
INVENTOR(S) : Shinichi Yatsuzuka, Yasumasa Hagiwara and Keiji Takizawa It is certified that error appears in the above-identified patent and that said Letters Patent is hereby corrected as shown below:

Title page,
Item [75], should read:

-- [75] Inventors: Shinichi Yatsuzuka, Aichi (JP)
Yasumasa Hagiwara, Aichi (JP)
Keiji Takizawa, Aichi (JP) --

Signed and Sealed this

Eighth Day of July, 2003

JAMES E. ROGAN
*Director of the United States Patent and Trademark Office*